US010724749B2

(12) United States Patent
Hasegawa et al.

(10) Patent No.: US 10,724,749 B2
(45) Date of Patent: Jul. 28, 2020

(54) DRAIN PAN AND REFRIGERATION CYCLE APPARATUS

(71) Applicant: Mitsubishi Electric Corporation, Tokyo (JP)

(72) Inventors: Yuki Hasegawa, Tokyo (JP); Takeshi Kawamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/099,503

(22) PCT Filed: Aug. 3, 2016

(86) PCT No.: PCT/JP2016/072834
§ 371 (c)(1),
(2) Date: Nov. 7, 2018

(87) PCT Pub. No.: WO2018/025356
PCT Pub. Date: Feb. 8, 2018

(65) Prior Publication Data

US 2019/0383501 A1 Dec. 19, 2019

(51) Int. Cl.

| | |
|---|---|
| ***F24F 1/36*** | (2011.01) |
| ***F24F 1/0007*** | (2019.01) |
| ***F24F 13/22*** | (2006.01) |

(52) U.S. Cl.
CPC ..... *F24F 1/36* (2013.01); *F24F 1/0007* (2013.01); *F24F 13/222* (2013.01); *F24F 2013/227* (2013.01)

(58) Field of Classification Search
CPC ..... F24F 1/36; F24F 13/222; F24F 1/0007; F24F 2013/227; F24F 13/22; F24F 1/02; F25D 2321/146
See application file for complete search history.

(56) References Cited

U.S. PATENT DOCUMENTS

| | | | | |
|---|---|---|---|---|
| 2017/0108230 | A1* | 4/2017 | Yamamoto ..... | F24F 13/22 |
| 2017/0254559 | A1* | 9/2017 | Yamamoto ..... | F24F 13/22 |

FOREIGN PATENT DOCUMENTS

| | | |
|---|---|---|
| JP | S47-040807 Y | 12/1972 |
| JP | S50-060655 U | 6/1975 |

(Continued)

OTHER PUBLICATIONS

International Search Report of the International Searching Authority dated Oct. 25, 2016 for the corresponding international application No. PCT/JP2016/072834 (and English translation).

(Continued)

*Primary Examiner* — Emmanuel E Duke
(74) *Attorney, Agent, or Firm* — Posz Law Group, PLC

(57) ABSTRACT

A drain pan includes: a drain pan unit that includes a horizontal water receiving unit and a vertical water receiving unit intersecting with each other in an L shape and is used as horizontal and vertical types; and a water discharge socket for discharging, from the drain pan unit, drain water received on the drain pan unit. A drain port is opened through a water-receiving surface of each of the horizontal water receiving unit and the vertical water receiving unit at a corner of intersection of the drain pan unit. The water discharge socket entirely covers the drain port on an outer side of the corner, which is a major angle side.

5 Claims, 7 Drawing Sheets

(56) References Cited

FOREIGN PATENT DOCUMENTS

| | | | |
|---|---|---|---|
| JP | S59-103190 | U | 7/1984 |
| JP | H04-113819 | U | 10/1992 |
| JP | H06-042770 | A | 2/1994 |
| JP | H06-117662 | A | 4/1994 |
| JP | 2008-128520 | A | 6/2008 |
| JP | 2010-078293 | A | 4/2010 |

OTHER PUBLICATIONS

Office Action dated Nov. 26, 2020 issued in corresponding JP patent application No. 2018-531038 (and English translation).

* cited by examiner

DRAIN PAN AND REFRIGERATION CYCLE APPARATUS

CROSS REFERENCE TO RELATED APPLICATION

This application is a U.S. national stage application of PCT/JP2016/072834 filed on Aug. 3, 2016, the contents of which are incorporated herein by reference.

TECHNICAL FIELD

The present invention relates to a drain pan and a refrigeration cycle apparatus in each of which generated dew is collected as drain water by an L-shaped drain pan unit and discharged out of the drain pan unit through a water discharge socket attached to the drain pan unit.

BACKGROUND ART

In a conventional refrigeration cycle apparatus such as an air-conditioning apparatus, dew is generated due to a temperature difference from external air when cold refrigerant flows into the apparatus. A drain pan that collects dew as drain water is disposed to prevent mold generation and component corrosion due to dew, and dew drop in the apparatus.

The drain pan collects dew as drain water on a flat plate water-receiving surface without leakage in the apparatus, and guides the drain water out of the apparatus.

In a disclosed drain pan, a dew-receiving drain pan unit includes an L-shaped intersection so that drain water can be collected and discharged whether an instrument serving as part of a refrigeration cycle apparatus and including the drain pan in which dew is generated is vertically or horizontally installed. It is also disclosed that a discharge port for discharging drain water collected by the L-shaped drain pan unit is disposed near a corner at which water-receiving surfaces of the drain pan unit intersect with each other (refer to Patent Literatures 1 and 2, for example).

CITATION LIST

Patent Literature

Patent Literature 1: Japanese Unexamined Patent Application Publication No 6-117662

Patent Literature 2: Japanese Unexamined Patent Application Publication No 6-42770

SUMMARY OF INVENTION

Technical Problem

In Patent Literature 1, the discharge port is formed on the inner side of the corner of the L-shaped drain pan unit, on which dew is received, so that drain water collected by the drain pan unit is discharged through the discharge port whether the instrument including the drain pan is vertically or horizontally installed.

However, the discharge port is provided at a position higher than either water-receiving surface of the drain pan unit. With this configuration, drain water is not discharged but remains on the water-receiving surface positioned lower than the discharge port due to a height difference between the water-receiving surface and the discharge port. Thus, the drain water cannot be completely discharged from the drain pan unit. In such a case, the drain water remaining in the drain pan unit potentially causes failure such as mold generation or component corrosion.

In Patent Literature 2, a water discharge unit connected with the drain port extends on an extended line from one of the water-receiving surfaces of the drain pan unit.

However, a lowest part of the drain port is positioned at a height same as that of the water-receiving surface of the drain pan unit only at one point, whereas a most part of the drain port is positioned higher than the one water-receiving surface of the drain pan unit. With this configuration, any drain water that cannot flow from the water-receiving surface to the discharge port is not discharged but remains, and as a result, the drain water cannot be completely discharged from the drain pan unit. In such a case, the drain water remaining in the drain pan unit potentially causes failure such as mold generation or component corrosion.

The present invention is intended to solve the above-described problem and provide a drain pan and a refrigeration cycle apparatus in each of which collected drain water is completely discharged from a drain pan unit so that failure such as mold generation or component corrosion due to any drain water remaining in the drain pan unit is prevented.

Solution to Problem

A drain pan according to an embodiment of the present invention includes: a drain pan unit that includes a horizontal water receiving unit and a vertical water receiving unit intersecting with each other in an L shape and is used as horizontal and vertical types; and a water discharge socket for discharging, from the drain pan unit, drain water received on the drain pan unit. A drain port is opened through a water-receiving surface of each of the horizontal water receiving unit and the vertical water receiving unit at a corner of the intersection of the drain pan unit. The water discharge socket entirely covers the drain port on an outer side of the corner, which is a major angle side.

In a refrigeration cycle apparatus according to another embodiment of the present invention, an instrument in which a drain pan including the above-described drain pan is disposed is horizontally or vertically installed.

Advantageous Effects of Invention

In a drain pan and a refrigeration cycle apparatus according to an embodiment of the present invention, a drain port is opened through both water-receiving surfaces of a horizontal water receiving unit and a vertical water receiving unit at an intersection corner of a drain pan unit. A water discharge socket entirely covers the drain port on an outer side of the corner, which is a major angle side. With this configuration, whether an instrument in which a drain pan including the drain pan is disposed is horizontally or vertically installed, the water discharge socket is positioned lower than the drain port opened through both water-receiving surfaces of the horizontal water receiving unit and the vertical water receiving unit of the drain pan unit. Thus, drain water collected on the water-receiving surface of either the horizontal water receiving unit or the vertical water receiving unit of the drain pan unit, serving as a lower surface, is completely discharged from the drain port opened through the water-receiving surface serving as the lower surface on which the drain water is collected to the water discharge socket positioned lower. Accordingly, the collected drain water can be completely discharged the drain pan unit, thereby preventing failure such as mold generation or component corrosion due to any drain water remaining in the drain pan unit.

DESCRIPTION OF EMBODIMENTS

Figure 1:
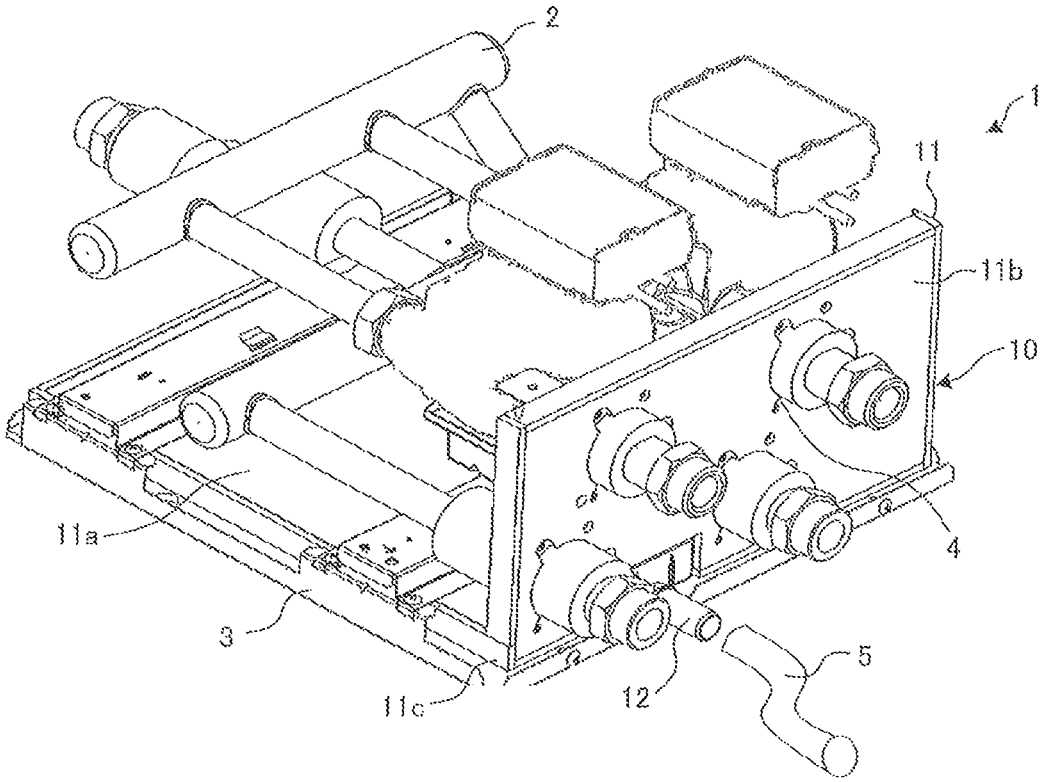
FIG. 1 is a perspective view illustrating a distributor including a drain pan according to Embodiment 1 of the present invention when a drain-water discharge direction horizontally extends.

Embodiments of the present invention will be described below with reference to the accompanying drawings.

In the drawings, components denoted by an identical reference sign are identical or equivalent to each other, which applies to the entire description of the specification.

In addition, any aspects of components indicated in the entire description of the specification are merely exemplary, and do not limit the present invention.

Embodiment 1

Figure 2:
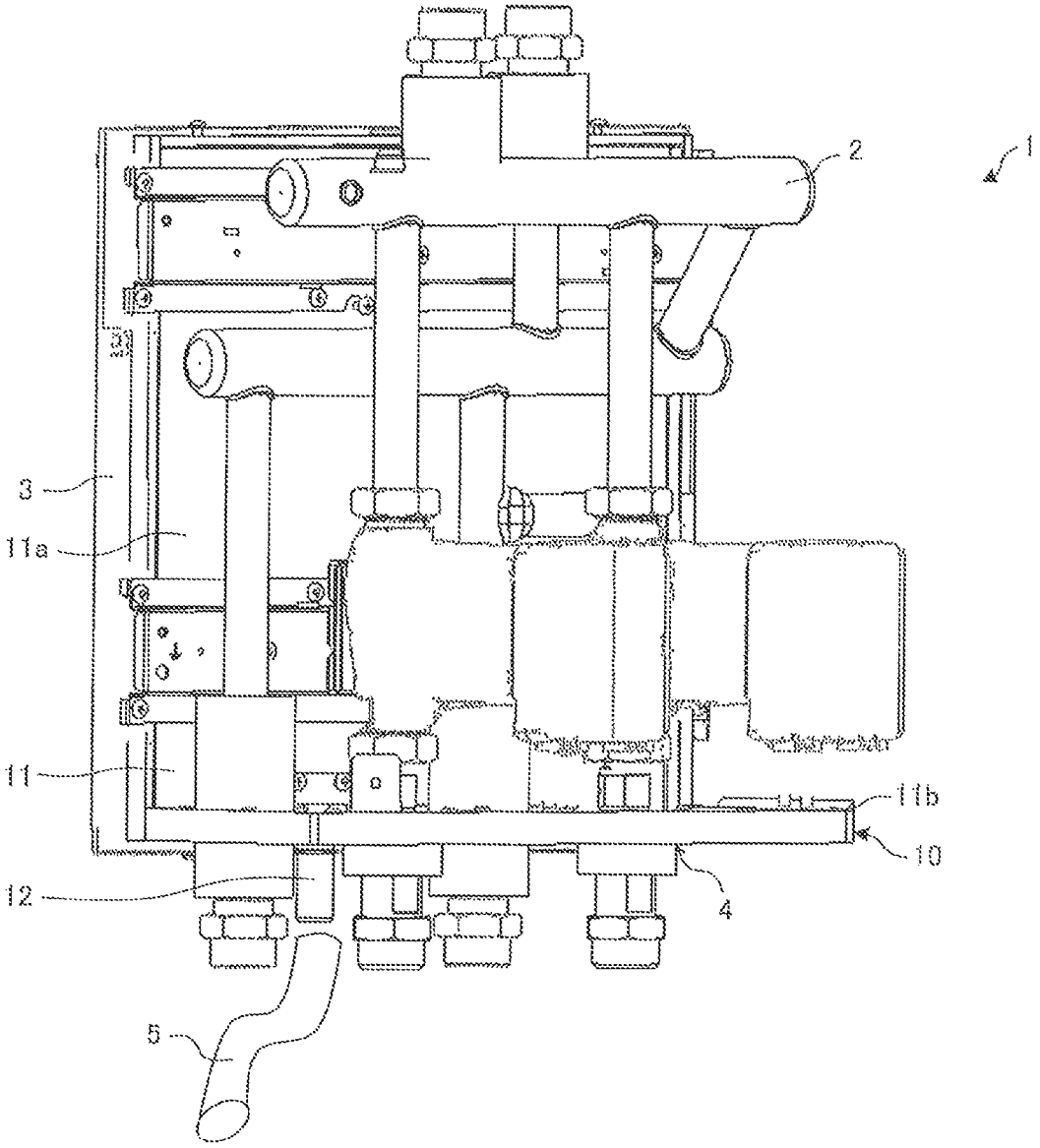
FIG. 2 is a side view illustrating the distributor including the drain pan according to Embodiment 1 of the present invention when the drain-water discharge direction vertically extends.

FIG. 1 is a perspective view illustrating a distributor 1 including a drain pan 10 according to Embodiment 1 of the present invention when a drain-water discharge direction horizontally extends. FIG. 2 is a side view illustrating the distributor 1 including the drain pan 10 according to Embodiment 1 of the present invention when the drain-water discharge direction vertically extends.

The distributor 1 is connected through a bifurcated pipe 2 with at least one outdoor unit and a plurality of indoor units included in a refrigeration cycle apparatus such as an air-conditioning apparatus, thereby distributing fluid to the respective indoor units through the pipe 2.

The distributor 1 is horizontally installed when the pipe 2 horizontally extends, or vertically installed when the pipe 2 vertically extends.

As illustrated in FIG. 1, the pipe 2 for distributing fluid horizontally extends when the distributor 1 is horizontally installed. The distributor 1 being horizontally installed includes an outer plate 3 at a lowest part.

The distributor 1 being horizontally installed includes, on the outer plate 3, the L-shaped drain pan 10 fixed to the outer plate 3 by a screw or the like.

The drain pan 10 includes a drain pan unit 11 configured to be used as horizontal and vertical types. The drain pan unit 11 is a member bent on an inner side by 90 degrees for receiving dew generated in the pipe 2. Specifically, the drain pan unit 11 includes a horizontal water receiving unit 11*a* and a vertical water receiving unit 11*b* intersecting with each other in an L shape. The horizontal water receiving unit 11*a* is a water-receiving surface serving as a lower surface of the drain pan unit 11 being used as the horizontal type. The vertical water receiving unit 11*b* is a water-receiving surface serving as a lower surface of the drain pan unit 11 being used as the vertical type. An outer side of the drain pan unit 11 is defined to be a side with a major angle of 270 degrees that is opposite to the inner side on which dew is received by the horizontal water receiving unit 11*a* and the vertical water receiving unit 11*b*.

The horizontal water receiving unit 11*a* is a long and wide plane plate fixed onto the outer plate 3 by a screw or the like. The horizontal water receiving unit 11*a* is shaped in a long and wide plane to receive, in a wide range, dew generated from horizontally extending the pipe 2. When horizontally installed as illustrated in FIG. 1, the distributor 1 collects the dew generated from the pipe 2 with a water-receiving surface that is the horizontal water receiving unit 11*a* serving as a lower surface.

The vertical water receiving unit 11*b* is a short and narrow plane plate orthogonal to the outer plate 3. The vertical water receiving unit 11*b* is shaped in the short and narrow plane to receive, in a narrow range around the pipe 2, dew generated from the vertically extending pipe 2.

The relation between the horizontal and vertical types is same as the relation between horizontal installation and vertical installation of the distributor 1. The vertically installed state is obtained by rotating the horizontally installed state by 90 degrees. The horizontal water receiving unit 11*a* and the vertical water receiving unit 11*b* may have identical plane sizes or plane sizes opposite to the sizes described above.

The horizontally extending pipe 2 is fixed to the horizontal water receiving unit 11*a* by a screw or the like. The pipe 2 passes through a pipe extraction hole 4 penetrating through the vertical water receiving unit 11*b* of the drain pan unit 11, and is connected with an external pipe outside of the distributor 1.

The drain pan 10 includes a water discharge socket 12 for discharging drain water received on the drain pan unit 11 from the drain pan unit 11.

When the distributor 1 is horizontally installed as illustrated in FIG. 1, the drain-water discharge direction horizontally extends, and an external water discharge hose 5 connected with the water discharge socket 12 horizontally extends.

When the distributor 1 is vertically installed as illustrated in FIG. 2, the drain-water discharge direction vertically extends, and the external water discharge hose 5 connected with the water discharge socket 12 vertically extends.

When vertically installed, the distributor 1 is in a state resulting when the distributor 1 being horizontally installed as illustrated in FIG. 1 is rotated by 90 degrees.

When vertically installed as illustrated in FIG. 2, the distributor 1 collects dew generated from the pipe 2 with a water-receiving surface that is the vertical water receiving unit 11*b* serving as a lower surface.

Figure 3:
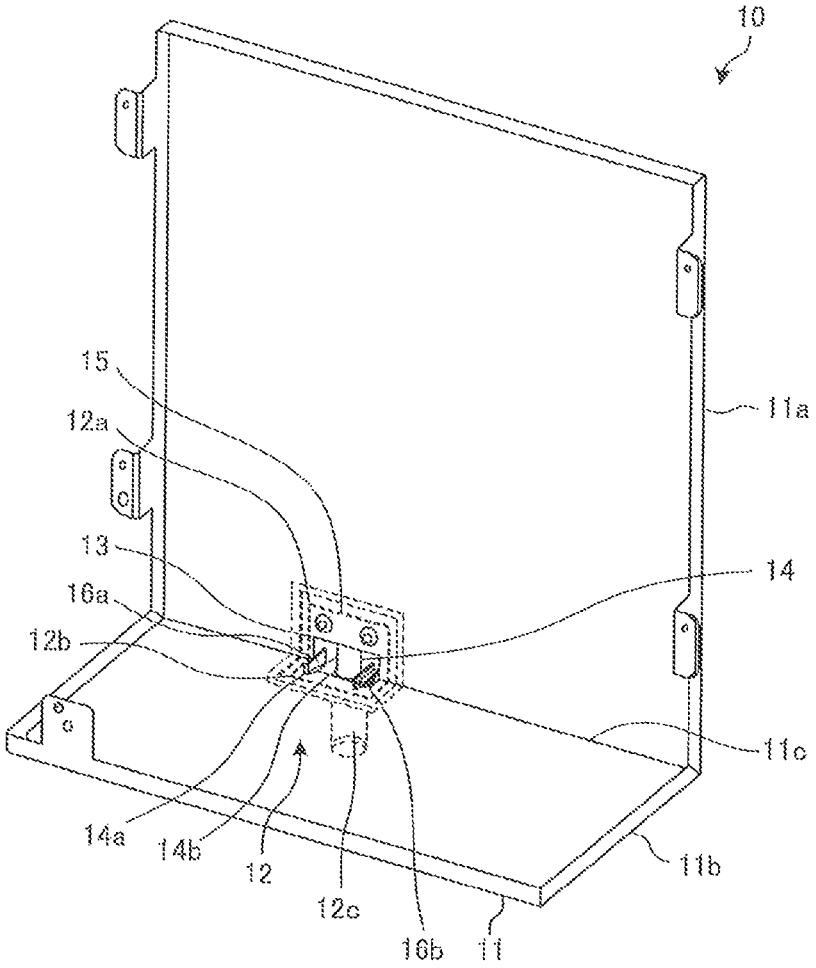
FIG. 3 is a perspective view illustrating the drain pan according to Embodiment 1 of the present invention when the drain-water discharge direction vertically extends.

FIG. 3 is a perspective view illustrating the drain pan 10 according to Embodiment 1 of the present invention when the drain-water discharge direction vertically extends. FIG. 3 omits illustration of the pipe extraction hole 4 through which the pipe 2 passes.

A drain port 13 is opened through both water-receiving surfaces of the horizontal water receiving unit 11*a* and the vertical water receiving unit 11*b*, on which drain water is received, at a corner 11*c* at which the horizontal water receiving unit 11*a* and the vertical water receiving unit 11*b* of the drain pan unit 11 intersect with each other in an L shape. In other words, the drain port 13 is composed of a part formed in the horizontal water receiving unit 11*a* and a part formed in the vertical water receiving unit 11*b*, which are connected with each other, and internally and externally penetrates through the drain pan unit 11.

The drain port 13 is opened in a rectangular shape in each of the horizontal water receiving unit 11*a* and the vertical water receiving unit 11*b*.

The horizontal water receiving unit 11*a* and the vertical water receiving unit 11*b* of the drain pan unit 11 may be each tilted so that the drain port 13 is placed at a lowest position relative to the water-receiving surface to efficiently discharge, from the drain pan unit 11 to the drain port 13, drain water collected on the water-receiving surface.

The water discharge socket 12 entirely covers the drain port 13 on the outer side, which is a major angle side, of the corner 11*c* at which the horizontal water receiving unit 11*a* and the vertical water receiving unit 11*b* of the drain pan unit 11 intersect with each other in an L shape.

The water discharge socket 12 includes two seating surfaces 12*a* and 12*b* that are formed in an L shape in accordance with the corner 11*c* at which the horizontal water receiving unit 11*a* and the vertical water receiving unit 11*b* of the drain pan unit 11 intersect with each other in an L shape. Specifically, the water discharge socket 12 includes the two seating surfaces 12*a* and 12*b* attached to the horizontal water receiving unit 11*a* and the vertical water receiving unit 11*b*, respectively, of the drain pan unit 11.

Figure 4:
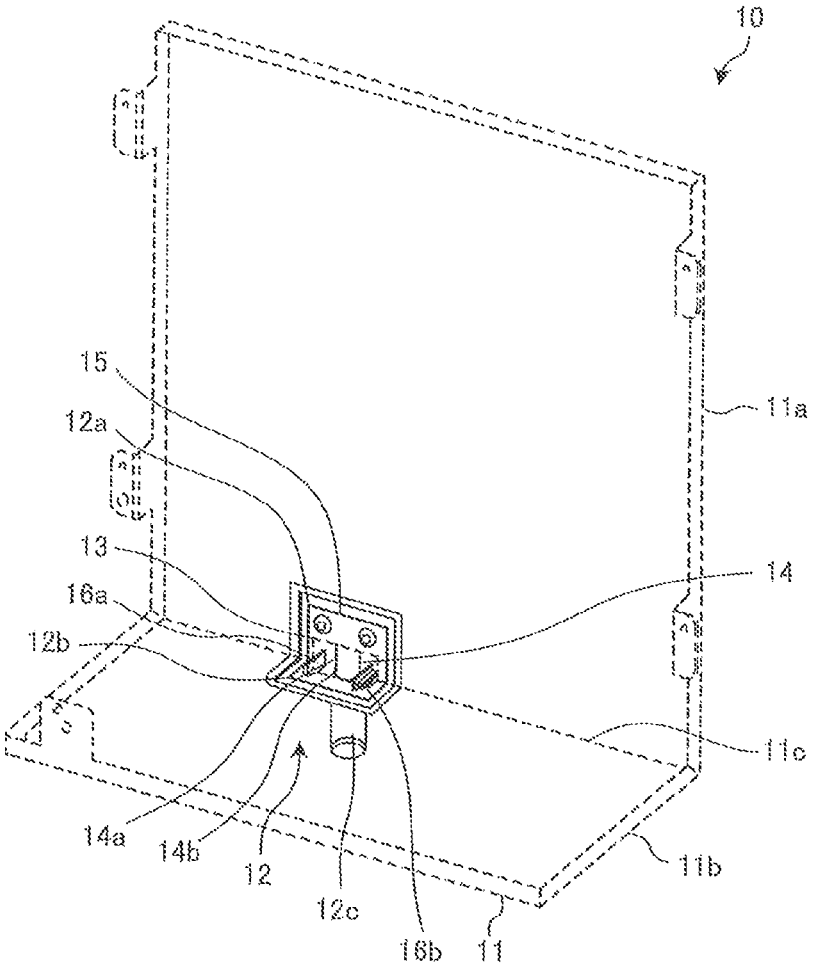
FIG. 4 is a perspective view illustrating a water discharge socket attached to the outer side of the drain pan, which is a major angle side, according to Embodiment 1 of the present invention when the drain-water discharge direction vertically extends.
Figure 5:
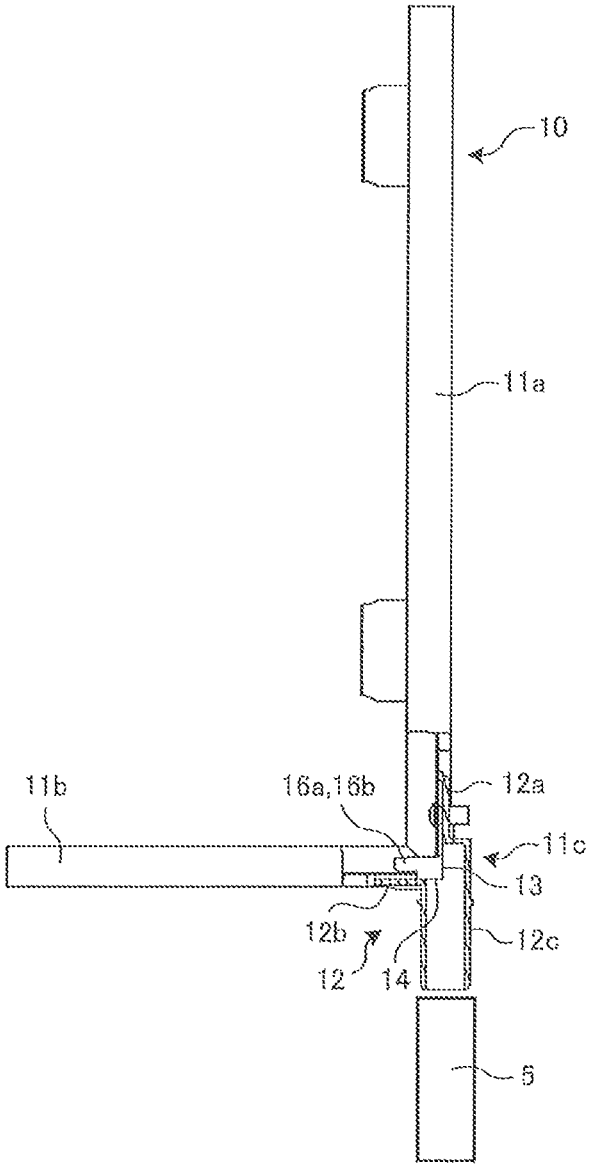
FIG. 5 is an explanatory diagram illustrating a section of the drain pan according to Embodiment 1 of the present invention when the drain-water discharge direction vertically extends.
Figure 6A:
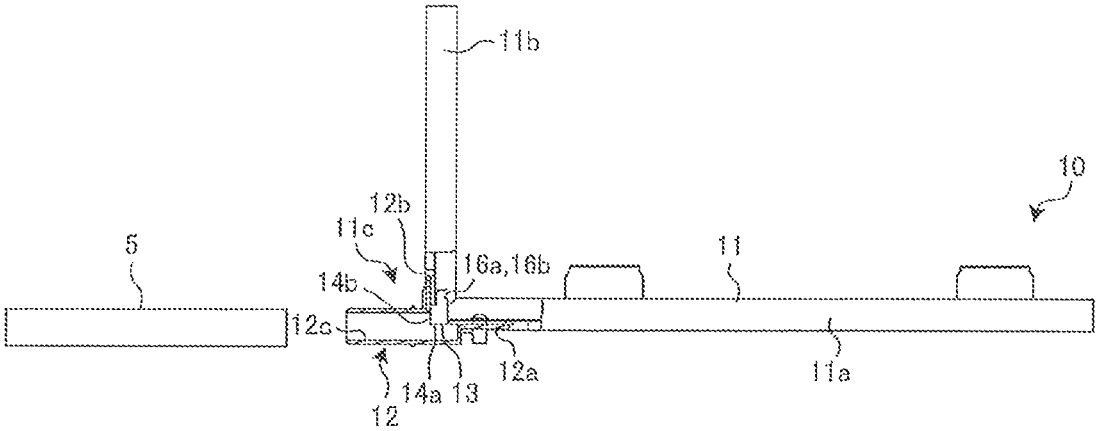
FIG. 6A is an explanatory diagram illustrating a section of the drain pan according to Embodiment 1 of the present invention when the drain-water discharge direction horizontally extends.
Figure 6B:
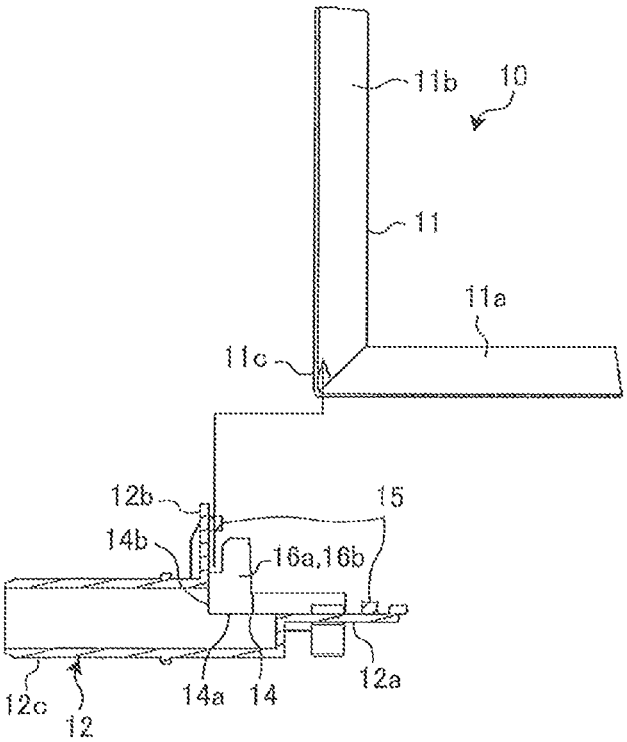
FIG. 6B is an explanatory diagram illustrating a section of a state before the water discharge socket is attached to a drain pan unit in the drain pan according to Embodiment 1 of the present invention when the drain-water discharge direction horizontally extends.

FIG. 4 is a perspective view illustrating the water discharge socket 12 attached to the outer side, which is a major angle side, of the drain pan 10 according to Embodiment 1 of the present invention when the drain-water discharge direction vertically extends. FIG. 5 is an explanatory diagram illustrating a section of the drain pan 10 according to Embodiment 1 of the present invention when the drain-water discharge direction vertically extends. FIG. 6A is an explanatory diagram illustrating a section of the drain pan 10 according to Embodiment 1 of the present invention when the drain-water discharge direction horizontally extends. FIG. 6B is an explanatory diagram illustrating a section of a state before the water discharge socket 12 is attached to the drain pan unit 11 in the drain pan 10 according to Embodiment 1 of the present invention when the drain-water discharge direction horizontally extends.

As illustrated in FIGS. 5 and 6A, the water discharge socket 12 includes a drain water discharge pipe 12*c* disposed lower than the water-receiving surface of the horizontal water receiving unit 11*a* or the vertical water receiving unit 11*b* of the drain pan unit 11, on which drain water is received, to discharge the drain water externally from the distributor 1 whether the distributor 1 is horizontally or vertically installed. The drain water discharge pipe 12*c* extends with its central axis line aligned with the plane of the horizontal water receiving unit 11*a*. The drain water discharge pipe 12*c* is cylindrical. The drain water discharge pipe 12*c* is connected with the external water discharge hose 5.

Since the drain water discharge pipe 12*c* is disposed lower than the water-receiving surface of the drain pan unit 11, on which drain water is received, whether the distributor 1 is horizontally or vertically installed, the drain water is completely discharged without remaining on the drain pan unit 11.

The two seating surfaces 12*a* and 12*b* of the water discharge socket 12 are integrated outside of the drain water discharge pipe 12*c*.

The drain water discharge pipe 12*c* may extend obliquely downward such that a downstream end part thereof is lower than an upstream end part thereof whether the distributor 1 is horizontally or vertically installed. The drain water discharge pipe 12*c* may be a pipe member having any shape, instead of cylindrical, such as rectangular cylindrical, triangular cylindrical, or elliptic cylindrical. The drain water discharge pipe 12*c* may have upstream and downstream halves in different shapes. For example, the upstream half of the drain water discharge pipe 12*c* may be rectangular cylindrical in accordance with the drain port 13, and the downstream half thereof may be cylindrical for easy connection with the external water discharge hose 5.

In the drain water discharge pipe 12*c*, an inflow opening port 14 connected with the drain port 13 includes an axial-direction cut part 14*a* and a radial-direction cut part 14*b* facing to the horizontal water receiving unit 11*a* and the vertical water receiving unit 11*b*, respectively, of the drain pan unit 11. In other words, the axial-direction cut part 14*a* is a part cut in the direction of the central axis of the drain water discharge pipe 12*c*. The radial-direction cut part 14*b* is a part cut in a semicircle in the radial direction of the drain water discharge pipe 12*c*. A part at which the axial-direction cut part 14*a* and the radial-direction cut part 14*b* are formed is semicylindrical.

The corner 11*c*, at which the horizontal water receiving unit 11*a* and the vertical water receiving unit 11*b* of the drain pan unit 11 intersect with each other in an L shape, can be fitted to the inflow opening port 14, which is opened through the axial-direction cut part 14*a* and the radial-direction cut part 14*b*. Accordingly, the drain port 13 of the drain pan unit 11 connects with the inflow opening port 14 of the drain water discharge pipe 12*c*.

As illustrated in FIG. 4, a sealing member 15 is bonded to the water discharge socket 12 around the two seating surfaces 12*a* and 12*b*, which are contact surfaces for the drain pan unit 11.

The sealing member 15 encloses, between the water discharge socket 12 and the drain pan unit 11, the drain port 13 and the inflow opening port 14 of the drain water discharge pipe 12*c* connected with the drain port 13.

As illustrated in FIG. 6B, the water discharge socket 12 is attached to the corner 11*c*, at which the horizontal water receiving unit 11*a* and the vertical water receiving unit 11*b* of the drain pan unit 11 intersect with each other in an L shape, while the sealing member 15 is being pressed down. When the sealing member 15 is pressed down, a gap between the drain pan unit 11 and the water discharge socket 12 is sealed to prevent drop of drain water through the gap.

The seating surface 12*a* as one of the two seating surfaces 12*a* and 12*b* of the water discharge socket 12 is attached to the drain pan unit 11 by screw fastening.

The other seating surface 12*b* as the two seating surfaces 12*a* and 12*b* of the water discharge socket 12 is attached by fitting clicks 16*a* and 16*b* protruding in the drain port 13 onto the drain pan unit 11.

The one seating surface 12*a* attached by screw fastening extends in parallel with the drain water discharge pipe 12*c*.

The clicks 16*a* and 16*b* protrude in a direction along the plane of the other seating surface 12*b* from the one seating surface 12*a* attached by screw fastening. The clicks 16*a* and 16*b* include, as parts contacting right and left edge parts of the drain port 13, linear protrusions protruding outward to right and left in T-shaped sections. Since only the linear protrusions contact the right and left edge parts of the drain port 13, gaps are formed between the clicks 16*a* and 16*b* and the right and left edge parts of the drain port 13. The clicks 16*a* and 16*b* also include stepped parts that contact the vertical water receiving unit 11*b* of the drain pan unit 11. Thus, although the other seating surface 12*b* is attached by fitting the clicks 16*a* and 16*b* protruding in the drain port 13 onto the drain pan unit 11, the vertical water receiving unit 11*b* is firmly fixed to the other seating surface 12*b* while a gap is formed between the clicks 16*a* and 16*b* to flow drain water therethrough. Thus, the clicks 16*a* and 16*b* do not encumber flow of drain water. With this configuration, drain water discharged through the drain port 13 flows on the two seating surfaces 12*a* and 12*b* to the inflow opening port 14 of the drain water discharge pipe 12*c*.

The fixations to the two seating surfaces 12*a* and 12*b* of the water discharge socket 12 may be both achieved by screwing or click fitting.

However, when the one seating surface 12*a* on the horizontal water receiving unit 11*a* of the drain pan unit 11 is attached to the drain pan unit 11 by screw fastening as in Embodiment 1, sufficient strength can be obtained against stress applied on the water discharge socket 12 when the external water discharge hose 5 is positioned in the direction of horizontal installation.

Figure 7:
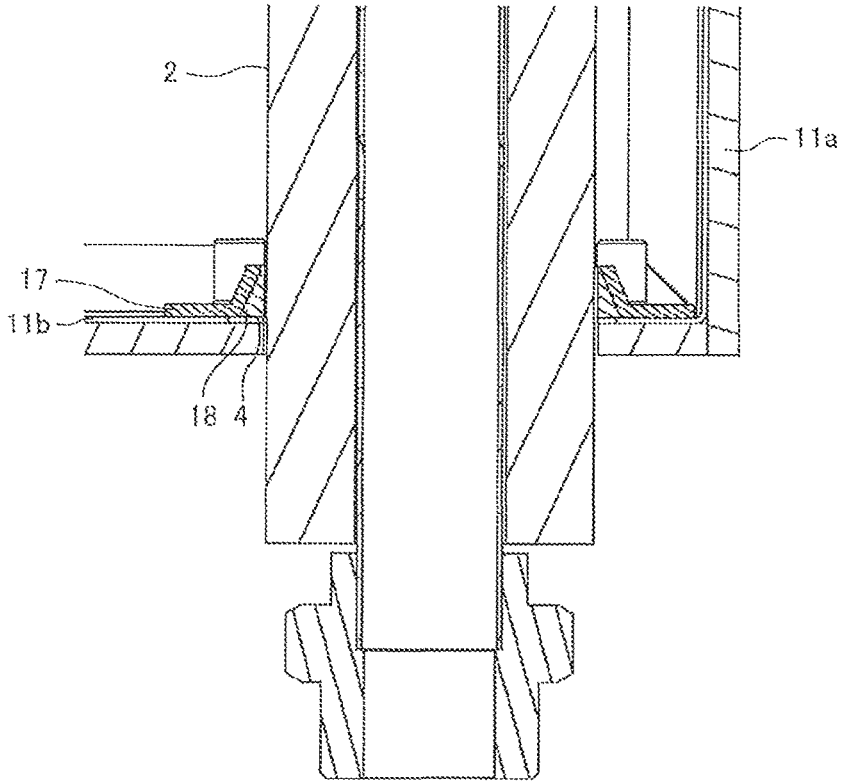
FIG. 7 is an enlarged explanatory diagram illustrating a section around a pipe extraction hole in which a pipe penetrating through the drain pan according to Embodiment 1 of the present invention is placed.

FIG. 7 is an enlarged explanatory diagram illustrating a section around the pipe extraction hole 4 through which the pipe 2 penetrating through the drain pan 10 according to Embodiment 1 of the present invention passes.

As illustrated in FIG. 7, the vertical water receiving unit 11*b* of the drain pan unit 11 is provided with the pipe extraction hole 4 through which the pipe 2 passes. A collar 17 raised higher than the water-receiving surface of the drain pan unit 11, on which drain water is received, is provided around the pipe extraction hole 4.

The collar 17 completely surrounds the pipe extraction hole 4 and is fixed to the vertical water receiving unit 11*b* by screwing.

The collar 17 is fixed to the vertical water receiving unit 11*b* while a sealing member 18 attached to the pipe 2 is being pressed down, which prevents drop of drain water from the pipe extraction hole 4 of the vertical water receiving unit 11*b*. The collar 17, which is raised higher than the water-receiving surface of the vertical water receiving unit 11*b*, serves as a bank that prevents drain water from entering into the pipe extraction hole 4. Accordingly, drain water accumulates up to the height of the collar 17 on the vertical water receiving unit 11*b* as a water-receiving surface, and is prevented from leaking out of the drain pan 10 of the distributor 1.

According to Embodiment 1, the drain pan 10 includes the drain pan unit 11 that includes the horizontal water receiving unit 11*a* and the vertical water receiving unit 11*b* intersecting with each other in an L shape and is used as horizontal and vertical types. The drain pan 10 includes the water discharge socket 12 for discharging, from the drain pan unit 11, drain water received on the drain pan unit 11. The drain port 13 is opened through both of the water-receiving surface of the horizontal water receiving unit 11*a* and the water-receiving surface of the vertical water receiving unit 11*b* at the corner 11*c* of the intersection of the drain pan unit 11. The water discharge socket 12 entirely covers the drain port 13 on the outer side of the corner 11*c*, which is a major angle side.

With this configuration, whether the distributor 1 including the drain pan 10 is horizontally or vertically installed, the water discharge socket 12 is positioned lower than the drain port 13 opened through both of the water-receiving surfaces of the horizontal water receiving unit 11*a* and the vertical water receiving unit 11*b* of the drain pan unit 11. With this configuration, drain water collected on the water-receiving surface of either of the horizontal water receiving unit 11*a* and the vertical water receiving unit 11*b* of the drain pan unit 11, serving as a lower surface is completely discharged from the drain port 13 opened through the water-receiving surface serving as the lower surface on which the drain water is collected to the water discharge socket 12 being positioned lower. Accordingly, the collected drain water can be completely discharged from the drain pan unit 11, thereby preventing failure such as mold generation or component corrosion due to any drain water remaining in the drain pan unit 11.

According to Embodiment 1, the water discharge socket 12 includes the drain water discharge pipe 12*c* disposed lower than either water-receiving surface of the drain pan unit 11 whether the distributor 1 is horizontally or vertically installed to discharge drain water externally from the distributor 1.

With this configuration, drain water collected on the water-receiving surface of either of the horizontal water receiving unit 11*a* and the vertical water receiving unit 11*b* of the drain pan unit 11, serving as a lower surface is completely discharged from the drain port 13 opened through the water-receiving surface serving as the lower surface on which the drain water is collected to the water discharge socket 12 being positioned lower. The drain water discharge pipe 12*c* is disposed lower than either water-receiving surface of the drain pan unit 11 whether the distributor 1 is horizontally or vertically installed. Accordingly, the drain water is discharged externally from the distributor 1 through the drain water discharge pipe 12*c* of the water discharge socket 12.

According to Embodiment 1, in the drain water discharge pipe 12*c*, the inflow opening port 14 connected with the drain port 13 includes the axial-direction cut part 14*a* and the radial-direction cut part 14*b* facing to the horizontal water receiving unit 11*a* and the vertical water receiving unit 11*b*, respectively, of the drain pan unit 11.

With this configuration, the corner 11*c*, at which the horizontal water receiving unit 11*a* and the vertical water receiving unit 11*b* of the drain pan unit 11 intersect with each other and the drain port 13 is opened, is fitted in the inflow opening port 14 of the drain water discharge pipe 12*c*. Then, the inflow opening port 14 connected with the drain port 13 of the drain water discharge pipe 12*c* guides, to the drain water discharge pipe 12*c*, drain water flowing downward from the drain port 13. Accordingly, the water discharge socket 12 discharges the drain water externally from the distributor 1 through the drain water discharge pipe 12*c*.

According to Embodiment 1, the water discharge socket 12 includes the two seating surfaces 12*a* and 12*b* attached to the horizontal water receiving unit 11*a* and the vertical water receiving unit 11*b*, respectively, of the drain pan unit 11. The seating surface 12*a* as one of the two seating surfaces 12*a* and 12*b* is attached to the drain pan unit 11 by screw fastening. The seating surface 12*b* as the other seating surface of the two seating surfaces 12*a* and 12*b* is attached by fitting the clicks 16*a* and 16*b* protruding in the drain port 13 onto the drain pan unit 11. The seating surface 12*a* attached by screw fastening extends in parallel with the drain water discharge pipe 12*c*.

With this configuration, the seating surface 12*a* of the water discharge socket 12, which is attached by screw fastening, receives large stress applied on the water discharge socket 12 when drain water is to be horizontally discharged. Thus, sufficient strength can be obtained against stress applied when the external water discharge hose 5 connected with the drain water discharge pipe 12*c* is positioned. Accordingly, the water discharge socket 12 has improved strength to prevent break of the water discharge socket 12.

According to Embodiment 1, the sealing member 15 enclosing the drain port 13 and the inflow opening port 14 of the drain water discharge pipe 12*c* connected with the drain port 13 is provided between the water discharge socket 12 and the drain pan unit 11.

This configuration can prevent drain water leak between the water discharge socket 12 and the drain pan unit 11.

According to Embodiment 1, the drain pan unit 11 is provided with the pipe extraction hole 4 through which the pipe 2 passes. The collar 17 raised higher than either water-receiving surface of the drain pan unit 11 is provided around the pipe extraction hole 4.

With this configuration, the collar 17 can prevent drain water leakage from the pipe extraction hole 4. Accordingly, drain water drop from the pipe extraction hole 4 can be prevented. In addition, drain water accumulating up to the height of the collar 17 on either water-receiving surface of the drain pan 10 can be prevented from leaking out of the distributor 1.

Embodiment 2

Figure 8:
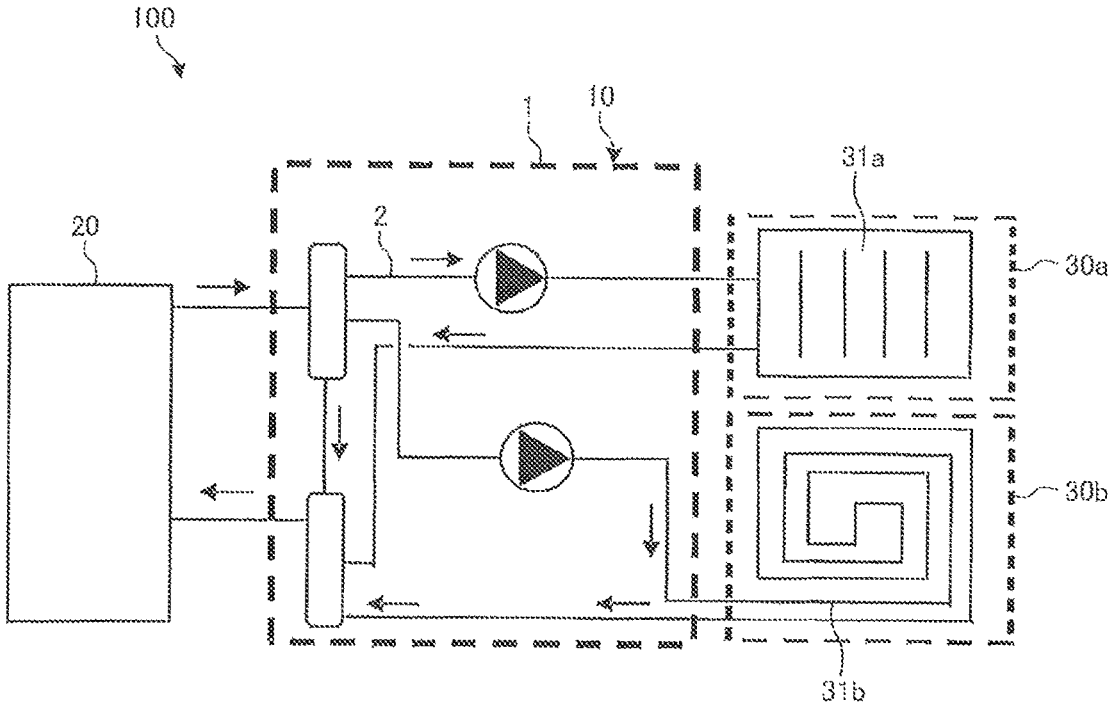
FIG. 8 is a circuit configuration diagram schematically illustrating an exemplary circuit configuration of a refrigeration cycle apparatus according to Embodiment 2 of the present invention.

FIG. 8 is a circuit configuration diagram schematically illustrating an exemplary circuit configuration of a refrigeration cycle apparatus 100 according to Embodiment 2 of the present invention.

Embodiment 2 describes an air-conditioning apparatus as an example of the refrigeration cycle apparatus 100. In FIG. 8, an arrow indicates flow of fluid such as refrigerant or water.

In the following description, fluid such as refrigerant or water supplied from a heat source apparatus 20 to the distributor 1 is collectively referred to as fluid.

The refrigeration cycle apparatus 100 includes, as a component, the distributor 1 according to Embodiment 1 described above.

Specifically, as illustrated in FIG. 8, the refrigeration cycle apparatus 100 includes the single heat source apparatus 20, two load-side apparatuses 30*a* and 30*b*, and the distributor 1.

In the example illustrated in FIG. 8, the single heat source apparatus 20 is provided, but the number of heat source apparatuses 20 is not particularly limited. A plurality of heat source apparatuses 20 may be provided in series or in parallel with the distributor 1. In the example illustrated in FIG. 8, the two load-side apparatuses 30*a* and 30*b* are provided, but three or more load-side apparatuses may be connected in parallel with the distributor 1.

The heat source apparatus 20 is used as, for example, an outdoor unit or an outdoor unit in accordance with usage of the refrigeration cycle apparatus 100 and supplies fluid to the load-side apparatuses 30*a* and 30*b* through fluid.

Although not illustrated, a compressor, an aperture device, a heat-source-side heat exchanger, and a fan are housed in the heat source apparatus 20.

When connected by pipes, these elements together with load-side heat exchangers housed in the load-side apparatuses 30*a* and 30*b* form a refrigerant circuit.

In this case, heat or cooling energy is stored in refrigerant as fluid and supplied from the heat source apparatus 20 to the load-side apparatuses 30*a* and 30*b*.

Alternatively, the heat source apparatus 20 may include, in addition to the heat-source-side heat exchanger, another heat exchanger to indirectly supply heat or cooling energy to the load-side apparatuses 30*a* and 30*b* through fluid such as water as heat medium. In such a case, the heat or cooling energy is stored in fluid such as water and supplied to the load-side apparatuses 30*a* and 30*b*. In this manner, heat or cooling energy stored in refrigerant in the heat source apparatus 20 may be transferred to another fluid such as water through the other heat exchanger, and then, this fluid may be supplied to the load-side apparatuses 30*a* and 30*b*.

In place of the fan, a pump for circulating water or antifreeze liquid is housed as a heat medium transfer device in the heat source apparatus 20 depending on the aspect of the heat-source-side heat exchanger.

The load-side apparatuses 30*a* and 30*b* are each used as, for example, an indoor unit, an indoor unit, or a hot-water supply unit in accordance with usage of the refrigeration cycle apparatus 100, and heat or cool air, water, or the like as a load side target by heat or cooling energy supplied from the heat source apparatus 20 through fluid.

For example, a load-side heat exchanger and a fan are housed in each of the load-side apparatuses 30*a* and 30*b*.

In place of the fan, a pump for circulating water or antifreeze liquid is housed as a heat medium convey device in each of the load-side apparatuses 30*a* and 30*b* depending on the aspect of the load-side heat exchanger.

The load-side heat exchanger housed in the load-side apparatus 30*a* is referred to as a load-side heat exchanger 31*a*. The load-side heat exchanger housed in the load-side apparatus 30*b* is referred to as a load-side heat exchanger 31*b*.

The distributor 1 is connected between the heat source apparatus 20 and the load-side apparatuses 30*a* and 30*b* to circulate fluid supplied from the heat source apparatus 20 in a distributing manner to each of the load-side apparatuses 30*a* and 30*b*.

In the distributor 1, dew is generated through condensation when cooling energy is circulated in a distributing manner so that fluid is supplied as a cooling load to the load-side apparatuses 30*a* and 30*b* through the pipe 2.

The distributor 1 includes the drain pan 10 described in Embodiment 1. The distributor 1 is horizontally or vertically installed. In the drain pan 10, the horizontal water receiving unit 11*a* or the vertical water receiving unit 11*b* of the drain pan unit 11 is disposed as a lower surface below the pipe 2, in which dew condensation occurs in the distributor 1, and serves as a water-receiving surface.

According to Embodiment 2, the distributor 1 including the drain pan 10 described in Embodiment 1 is horizontally or vertically installed in the refrigeration cycle apparatus 100.

With this configuration, in the distributor 1, drain water collected on the water-receiving surface of either of the horizontal water receiving unit 11*a* and the vertical water receiving unit 11*b* of the drain pan unit 11, serving as the lower surface, is completely discharged from the drain port 13 opened through the water-receiving surface serving as the lower surface on which the drain water is collected to the water discharge socket 12 being positioned lower. Accordingly, the collected drain water is completely discharged from the drain pan unit 11, thereby preventing failure such as mold generation or component corrosion due to any drain water remaining in the drain pan unit 11.

In Embodiments 1 and 2 of the present invention, the distributor 1 is described as part of the refrigeration cycle apparatus 100 including the drain pan 10. However, the drain pan may be applied to a load-side apparatus such as an indoor unit horizontally or vertically installed or an instrument such as an outdoor unit including another drain pan, which is part of the refrigeration cycle apparatus. In such a case, too, in the drain pan, the horizontal water receiving unit or the vertical water receiving unit of the drain pan unit is disposed as a lower surface below a drain water generating place such as a pipe or a heat exchanger in which dew is generated in the instrument including the drain pan, and serves as a water-receiving surface.

REFERENCE SIGNS LIST

1 distributor, 2 pipe, 3 outer plate, 4 pipe extraction hole, 5 external water discharge hose, 10 drain pan, 11 drain pan unit, 11*a* horizontal water receiving unit, 11*b* vertical water receiving unit, 11*c* corner, 12 water discharge socket, 12*a* seating surface, 12*b* seating surface, 12*c* drain water discharge pipe, 13 drain port, 14 inflow opening port, 14*a* axial-direction cut part, 14*b* radial-direction cut part, 15 sealing member, 16*a* click, 16*b* click, 17 collar, 18 sealing member, 20 heat source apparatus, 30*a* load-side apparatus, 30*b* load-side apparatus, 31*a* load-side heat exchanger, 31*b* load-side heat exchanger, 100 refrigeration cycle apparatus.

The invention claimed is:

1. A drain pan comprising:

a drain pan unit that includes a horizontal water receiving unit and a vertical water receiving unit intersecting with each other in an L shape and is used as horizontal and vertical types; and a water discharge socket for discharging, from the drain pan unit, drain water received on the drain pan unit, wherein a drain port is opened through a water-receiving surface of each of the horizontal water receiving unit and the vertical water receiving unit at a corner of the intersection of the drain pan unit, the water discharge socket entirely covers the drain port on an outer side of the corner, which is a major angle side, the water discharge socket includes a drain water discharge pipe disposed lower than the water-receiving surface of the drain pan unit to discharge drain water externally from an instrument in which the drain pan is disposed whether the instrument is horizontally or vertically installed, and in the drain water discharge pipe, an inflow opening port connected with the drain port includes an axial-direction cut part and a radial-direction cut part facing to the horizontal water receiving unit and the vertical water receiving unit, respectively, of the drain pan unit.

2. The drain pan of claim 1, wherein the water discharge socket includes two seating surfaces attached to the horizontal water receiving unit and the vertical water receiving unit, respectively, of the drain pan unit, one of the two seating surfaces is attached to the drain pan unit by screw fastening, an other of the two seating surfaces is attached by fitting a click protruding in the drain port onto the drain pan unit, and the seating surface attached by screw fastening extends in parallel with the drain water discharge pipe.

3. The drain pan of claim 1, wherein a sealing member enclosing the drain port and the inflow opening port of the drain water discharge pipe connected with the drain port is provided between the water discharge socket and the drain pan unit.

4. The drain pan of claim 1, wherein the drain pan unit is provided with a pipe extraction hole through which a pipe passes, and a collar raised higher than the water-receiving surface of the drain pan unit is provided around the pipe extraction hole.

5. A refrigeration cycle apparatus comprising the drain pan of claim 1, wherein an instrument in which the drain pan is included is horizontally or vertically installed.

* * * * *